United States Patent [19]

Aldrich et al.

[11] Patent Number: 4,606,661

[45] Date of Patent: Aug. 19, 1986

[54] PROPORTIONAL VERTICAL AND HORIZONTAL RIBBON TRACKING FOR IMPACT PRINTERS

[75] Inventors: Charles S. Aldrich; James R. Booth; William M. Schuller; Lloyd P. Young, all of Lexington, Ky.

[73] Assignee: International Business Machines Corporation, Armonk, N.Y.

[21] Appl. No.: 607,551

[22] Filed: May 7, 1984

[51] Int. Cl.[4] ..... B41J 33/54; B41J 33/56

[52] U.S. Cl. ..... 400/213; 400/208; 400/212; 400/225; 400/227; 400/227.2; 400/232

[58] Field of Search ..... 400/208, 212, 213, 213.1, 400/217, 217.1, 224, 224.1, 225, 227, 227.2, 232, 236.1, 248; 318/696

[56] References Cited

U.S. PATENT DOCUMENTS

| | | | |
|---|---|---|---|
| 3,401,783 | 9/1968 | Norwood et al. | 400/227 X |
| 3,444,979 | 5/1969 | Francisco | 400/227 X |
| 3,548,994 | 12/1970 | Hudson | 400/227 |
| 3,613,857 | 10/1971 | Thevis et al. | 400/217.1 |
| 4,247,210 | 1/1981 | Kacmarcik et al. | 400/236.1 |
| 4,297,043 | 10/1981 | Dargatz | 400/224 |
| 4,302,118 | 11/1981 | Schaefer | 400/213.1 X |
| 4,329,072 | 5/1982 | Kacmarcik | 400/225 X |
| 4,347,007 | 8/1982 | Schaefer | 400/213.1 X |
| 4,397,575 | 8/1983 | Aldrich | 400/208 |
| 4,471,283 | 9/1984 | Presley | 318/696 |

FOREIGN PATENT DOCUMENTS

| | | | |
|---|---|---|---|
| 0157394 | 12/1981 | Japan | 400/212 |
| 0161188 | 12/1981 | Japan | 400/212 |
| 0162684 | 12/1981 | Japan | 400/213 |

*Primary Examiner*—Ernest T. Wright, Jr.
*Attorney, Agent, or Firm*—William J. Dick

[57] ABSTRACT

A method of and apparatus for proportional ribbon (23) tracking on a printer (20), the printer (20) including a carrier (30) upon which implements of printing, for example the printwheel (25), ribbon (23) and hammer (28) are all mounted for translation opposite a platen (21). Ribbon lift mechanism is provided for effecting elevation of a ribbon (23) to multiple predetermined positions or tracks (1–10) (FIG. 3B) intermediate a printwheel (25) and a platen (21) so that indicia or character may be printed on print receiving medium (22) held thereby. In essence, an input means (11) receives a character to be printed. The microprocessor (13), in conjunction with the ROM (15), characterizes the character in accordance with a predetermined plurality of characteristics. In accordance with ribbon lift and feed algorithms, a particular characteristic of the character to be printed is added to a position on the ribbon upon which at least one prior character has been printed. In this manner a new print position is determined. Thereafter, the new track print position is outputted to the ribbon lift and feed means for effecting elevation of said ribbon (23) to one of a multiple of predetermined positions to thereby approximately maximize the number of predetermined positions of said ribbon with characters thereon which may be printed without character overlap.

12 Claims, 9 Drawing Figures

| | | | | | | | | |
|---|---|---|---|---|---|---|---|---|
| OVERSCORE | (1) | | | | | | | |
| ASCENDERS | (2) | | | | | | | |
| MAIN | (3) | a | b | g | | ö | | b |
| DESCENDERS | (4) | | | | | | | |
| UNDERSCORE | (5) | | | | — | | — | |
| | | | | | | | | |
| BASELINE | | 3 | 3 | 4 | 5 | 3 | 5 | 3 |
| HEIGHT | | 1 | 2 | 2 | 1 | 3 | 1 | 2 |
| WIDTH | | 5 | 5 | 5 | 5 | 6 | 5 | 5 |

FIG. 3A
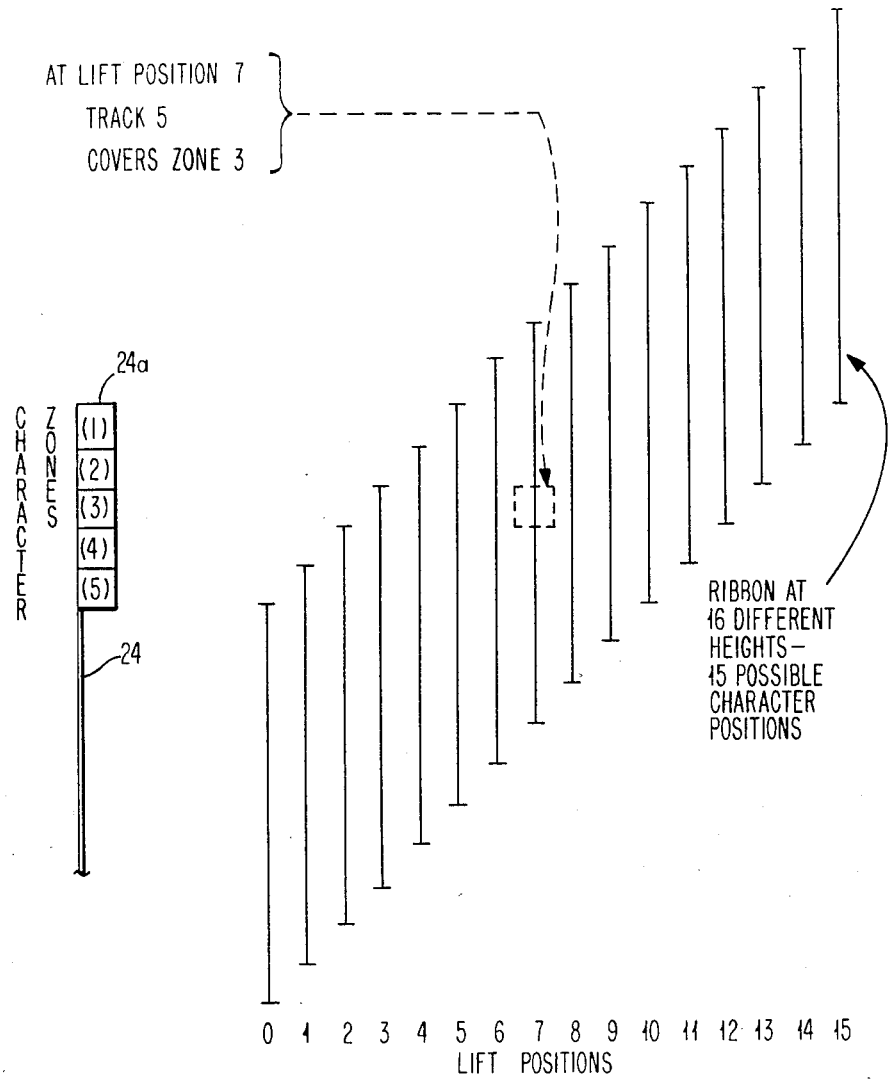
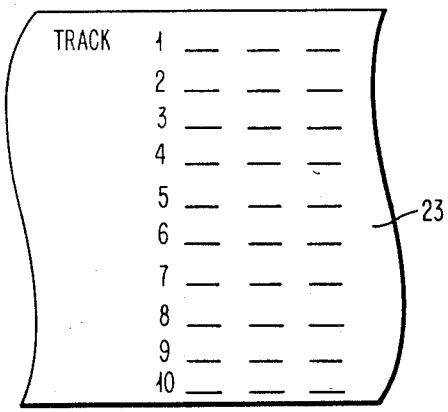
FIG. 3B

| EXAMPLE | NXTTRK | LIFT ADDRESS | RELATIVE LIFT | H | B |
|---|---|---|---|---|---|
| INITIAL CONDITIONS | 1 | 0 | — | — | — |
| PRINT a | 2 | 3 | +3 | 1 | 3 |
| b | 4 | 5 | +2 | 2 | 3 |
| g | 6 | 6 | +1 | 2 | 4 |
| — | 7 | 6 | 0 | 1 | 5 |
| ⋮ | 10 | 11 | +5 | 3 | 3 |
| O | 11 | 10 | −1 | 1 | 5 |
| — | 3 | 4 | −6 | 2 | 3 |
| b | | | | | |

PROPORTIONAL VERTICAL AND HORIZONTAL RIBBON TRACKING FOR IMPACT PRINTERS

DESCRIPTION

1. Technical Field

The present invention relates to a method of and apparatus for effecting ribbon lift in impact printers, which ribbon lift is proportional to the height of the character being printed to thereby maximize the ribbon usage.

With quality print trail printers for personal computers being in increased demand, for example daisy wheel printers, maximum ribbon life is a selling point in printer sales. When film ribbon is employed for typewriters or printers, only a small portion of the ink carried by the ribbon is actually transferred to the paper. The reason for this is that conventional film ribbon transfers all of the ink carried on the ribbon to the paper in the area where it is struck, and all characters are treated as if they cover the maximum possible ribbon area. This means that at best, ribbon lift as well as ribbon feed are always sized for the maximum character size. The description set forth below describes a technique where much more of the ink carried by the film ribbon may be transferred to the paper by lifting approximately only as much ribbon as is actually covered by the character. This means that ribbon feed and ribbon lift may be dictated by the character to be printed.

2. Background Art

The prior art, such as that set forth in U.S. Pat. No. 3,401,783, is representative of proportional ribbon feeding art wherein longitudinal ribbon feed is a function of the width of the character printed. However, no proportional ribbon lift (i.e. proportional to the height of the character being printed) is illustrated.

DISCLOSURE OF THE INVENTION

Disclosed is a method and apparatus for effecting ribbon lift in impact printers, which ribbon lift is proportional to the height of the character being printed. This is accomplished by dividing the maximum height character box into a plurality of zones, for example five such zones corresponding to underline, descender, main, ascender and overscore. By knowing the base line of a character that is to be printed as well as the number of zones the character covers (its height) and the last used place on the ribbon that was printed, a maximum number of characters may be stacked in a vertical column on the ribbon.

Moreover, a maximum number of characters may be obtained from the ribbon by combining proportional ribbon lift with proportional ribbon feed. Numerous techniques may be employed to increase the number of characters permitted on the print ribbon. For example, the simplest technique would permit the printing on multiple levels (lifts) of, for example, an underline. Other, larger letters may be printed employing a multiple-increment ribbon lift prior to ribbon feed. Where the lift is dependent on character height, true proportionality of ribbon lift to the character(s) being printed is obtained.

In the printing of characters or indicia, the character position on, for example, a printwheel, its height and width, are all taken into consideration in determining proper ribbon lift to expose the printwheel character to a fresh section of ribbon without wasting ribbon, or leaving substantial portions of unused and virgin ribbon, to thereby increase the number of characters that may be printed utilizing a single ribbon, such as a correctable film ribbon.

Other advantages of the method and apparatus of the present invention may be derived from the following specification and claims taken in conjunction with the accompanying drawings in which:

BRIEF DESCRIPTION OF DRAWINGS

FIG. 3A is a schematic drawing of ribbon lift positions relative to a petal of a printwheel on the printer illustrated in FIG. 2, and showing various lift positions for the ribbon relative to the printwheel;

FIG. 3B is an enlarged fragmentary sectional view of ink ribbon illustrating an imaginary position of 'tracks' on the ribbon;

BEST MODE FOR CARRYING OUT THE INVENTION

Background

Figures 1, 4:
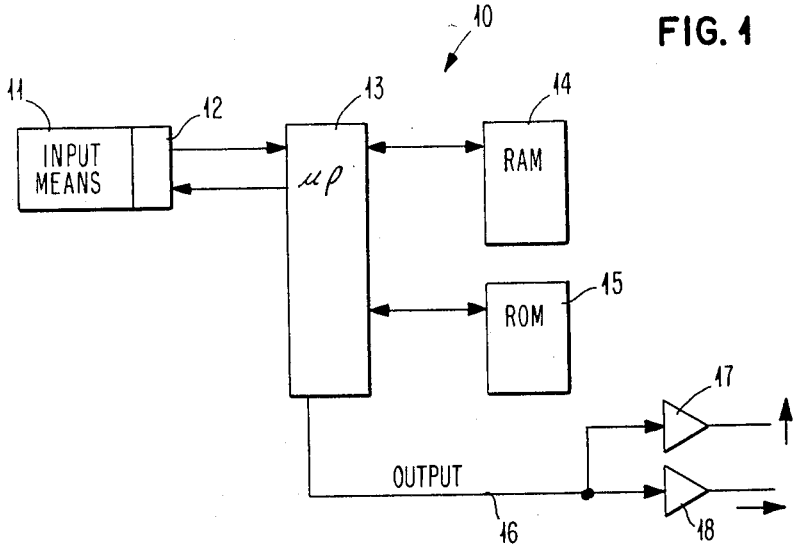
FIG. 1 is a schematic diagram of a portion of the electrical control means for a typical impact printer incorporating the method and apparatus of the present invention.
FIG. 4 is a table illustrating example characters, where the characters fit within the scheme, and the character characteristics which are required for the proportional ribbon lift method and apparatus in accordance with the present invention.

Referring now to the drawing, and especially FIG. 1 thereof, a portion 10 of the electrical control means for a typical impact printer incorporating the method and apparatus of the present invention is illustrated therein. At the outset, it should be recognized that the term printer encompasses both the conventional 'line' printer, as well as the printer portion of a typewriter (typically an electronic typewriter such as the IBM Model 85). By way of example only, the control portion of the printer will include an input means 11, such as keyboard in the instance of a typewriter, or a computer connected to storage devices, such as disk or tape. Associated with the control portion 10, and again by way of example only, is a buffer 12 which permits the storage of input characters in a queue along with control commands for appropriate operation thereon by a microprocessor 13. Associated with the microprocessor 13, either located internally thereof or as separate module(s) is a block of random access memory 14 which may be used for standard purposes (variable storagee, command storage, and character storage) as the case may be. The control portion 10 also includes a read only memory 15 which is connected to the microprocessor 13, and contains appropriate algorithms for controlling the text management function of the printer. These algorithms are loaded, as called for by the microprocessor 13 and the controlling information contained in ROM 15 so as to control, as through an output line 16, various moving parts of the printer. Inasmuch as the principle interest, in the present instance, is for ribbon lift and ribbon feed, ribbon lift electronics 17 and ribbon feed electronics 18 for controlling stepping motors and the like (hereinafter discussed relative to FIGS. 2A and 2B) may be conventional and are shown illustratively.

At the outset it should be noted that the text management function may appear anywhere in the system. For example, if the input means 11 includes a computer, the management of the text may be performed in the computer itself with raw commands being applied to the microprocessor 13 for calling up pure printer control commands and character indicia as described hereinafter. Alternatively, in a typewriter (electronic typewriter) the input means may include other microprocessors similar to the printer control portion 10 which serves to monitor the keys on the keyboard of the typewriter so as to request, through the buffer 12, printer control portion 10 to print a graphic. In its simplest form, in response to the command that is passed to the microprocessor 13, its associated RAM 14 and ROM 15, microprocessor 13 looks up, in a character characteristic table in the ROM 15, the base line, height, width etc. of the particular graphic (character) that is to be printed. Realistically, other parameters are held in the character characteristic table in the ROM 15, for example hammer velocity and wheel petal number of the graphic that is to be printed. The width of the character may also be passed to an essentially conventional escapement control component so that a carrier upon which the printing implements are mounted may escape. The hammer velocity may also be passed to a hammer control component so that the petal may be struck with the correct force.

Figure 5:
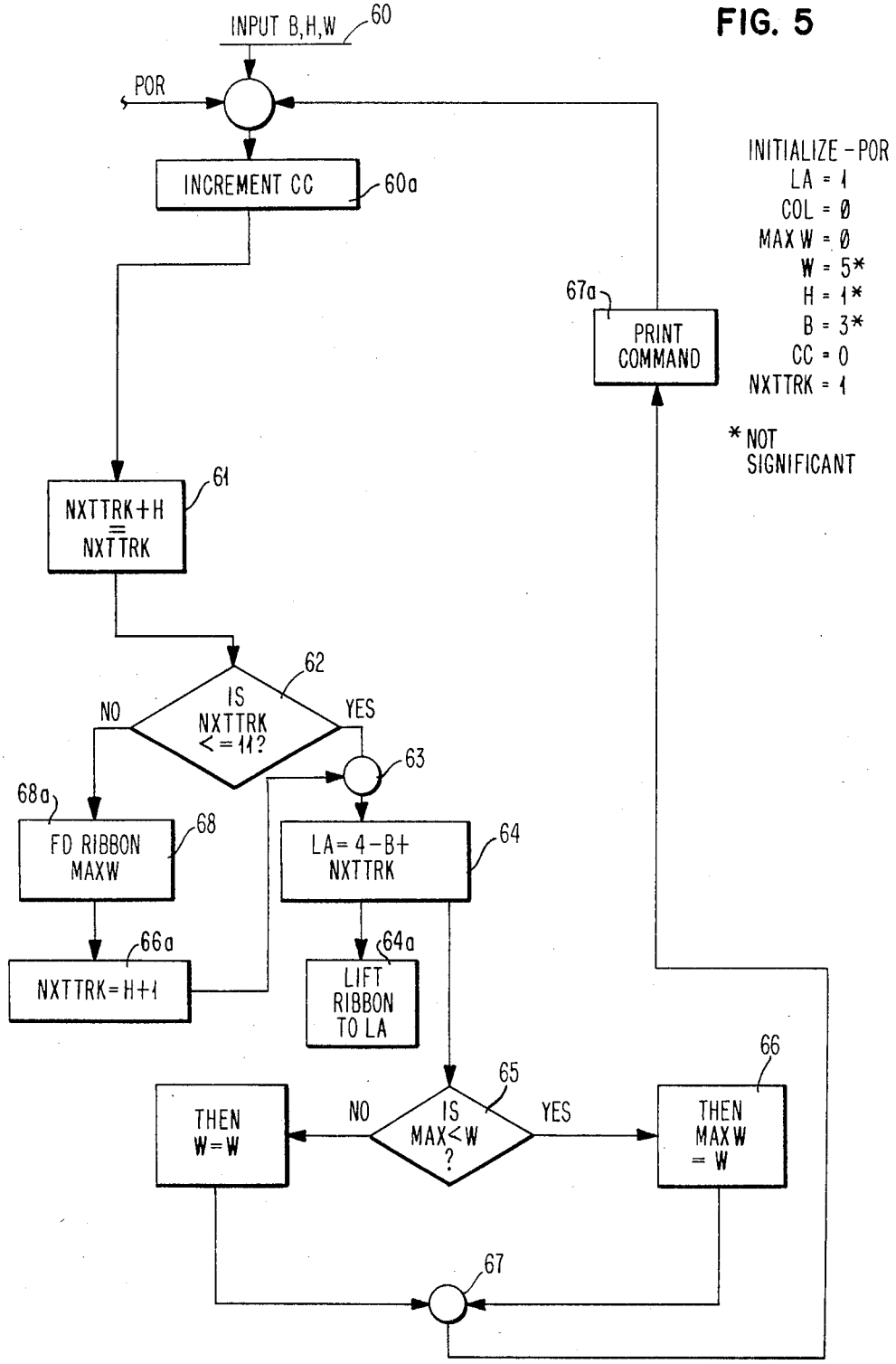
FIG. 5 is a flow chart illustrating the program logic of the novel method used in conjunction with the apparatus illustrated in FIGS. 1 and 2.

The present invention relates to the passing of certain character characteristics from the ROM 15, such as character width, height, base line, to control the ribbon lift in accordance with the program charted in FIG. 5 to effect desired ribbon control.

Sample Hardware

It should be noted that the present invention is particularly useful with impact printers, for example daisy wheel printers, but may also be useful with printers of a thermal nature wherein heat causes flow of the ink from the ribbon onto paper or the like, and with which it is desirable to maximize the use of the ribbon.

Figure 2A:
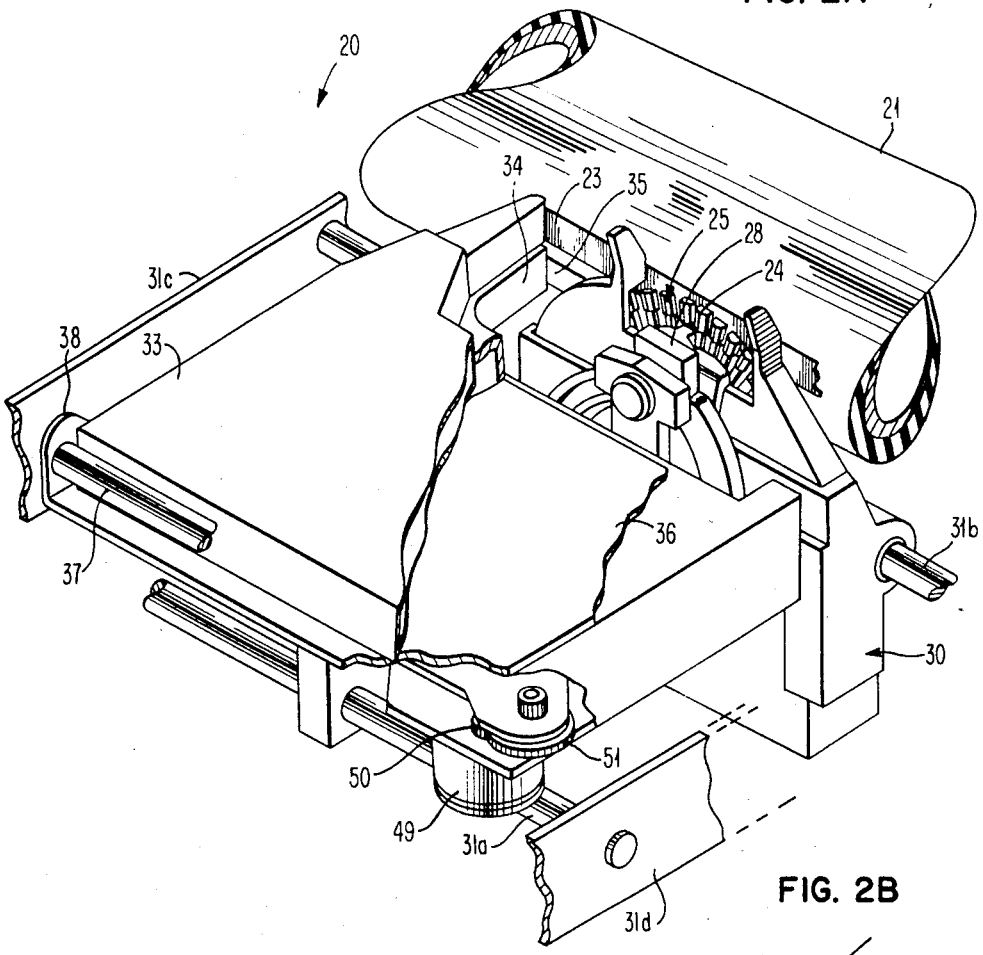
FIG. 2A is a fragmentary perspective view of a portion of a printer illustrating typical apparatus which may be adapted to the present invention.
Figure 2B:
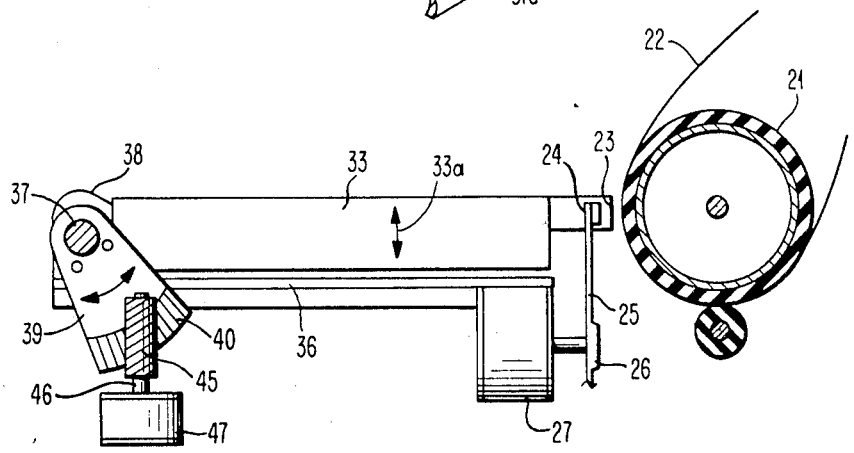
FIG. 2B is a diagramatic side elevational view of the apparatus illustrated in FIG. 2A.

Referring now to the sample impact printer 20 illustrated in FIGS. 2A and 2B, this printer includes a platen 21 about which print receiving media such as paper 22 is fed to permit indicia (characters etc.) to be printed thereon as through ink ribbon 23 passing intermediate platen 21 and print petals 24 of a print wheel (daisy wheel) 25. Typically the printwheel 25 has a hub or a central portion 26 (FIG. 2B) which is connected to a stepping motor 27 for control by the printer control portion 10. As is conventional, when the selected petal 24 is opposite the ribbon 23, a print hammer 28 is energized to effect impact of the petal 24 against the ribbon 23 and therefore against the paper 22.

The implements of printing comprise a printhead, in the illustrated instance including the print wheel 25 and hammer 28 and also comprise the ribbon 23, all of which are mounted on a print carrier 30 for translation, in the present instance on shafts 31*a* and 31*b* between the side frames 31*c* and 31*d* of the machine. Also mounted on the carrier 30 as part of the implements of printing are means for holding a supply of ribbon 23, in the illustrated instance a ribbon cartridge 33. It should be understood, however, that the ribbon cartridge 33 may be positioned off print carrier 30. In this type of implementation, however, separate means must be employed to effect elevation and depression of the ribbon 23 intermediate the print wheel 25 and paper-carrying platen 21.

In the event that the printer 20 is associated with a typewriter and it is desired to have correction capability with the typewriter, the cartridge 33 may include a depending cassette or the like 34 which places correction ribbon or tape 35 intermediate the print wheel 25 and the paper 22 for correction purposes in a well known manner. For purposes of the present invention, it is unnecessary to detail the manner in which correction tape 35 is lifted into position for correction purposes and subsequently fed. It is sufficient that the cartridge 33 with ink ribbon 23 may be elevated and lowered as shown by the arrow 33*a* in FIG. 2B to position the ribbon 23 properly with respect to the indicia-carrying print petal 24 to permit impact of the indicia, through the ribbon 23 and onto the paper 22.

The cartridge 33 may be positioned on a platform or the like 36 (FIG. 2B) which forms part of the carrier 30, and which may be elevated and lowered to effect elevation and depression of the cartridge 33 and thus the print ribbon 23. This is accomplished, in the illustrated instance, by an axel 37 which is journaled through brackets 38 (FIG. 2B) connected to the depending cartridge support means or platform 36. At the terminal end of the shaft 37 is a gear segment 39 which includes teeth 40 thereon which mesh with a pinion gear 45 connected to the shaft 46 of a drive means, in the illustrated instance and preferred embodiment, a stepping motor 47.

If it is desired, and as described in the preferred embodiment, the ribbon feed as well as the ribbon lift are proportional to the characters being printed. Accordingly, it is necessary that ribbon feed be independent of ribbon lift. To this end, and as illustrated best in FIG. 2A, a second drive means, in the illustrated instance and in the preferred embodiment, a stepping motor 49, is connected through a pinion gear 50 to a drive gear 51. This coupling effects, in a predetermined rotation at a predetermined and preselected time, feed of the ribbon 23 so as to always expose a fresh portion of ribbon 23 (longitudinally) opposite the print wheel 25.

The drive for the stepping motors 27, 47 are under microprocessor 13 control and the associated electronics, i.e. 17 and 18 for ribbon lift and ribbon feed respectively may take any well known form, or may preferably be of the form disclosed in patent application Ser. No. 438,439, filed Nov. 2, 1982, now U.S. Pat. No. 4,471,283, issued Sept. 11, 1984, entitled "Average Current Regulation for Stepper Motors", D. R. Presley, and owned by the assignee of the present invention.

It should be recognized that there are numerous drive schemes for ribbon feed and ribbon lift which may be employed by one skilled in the art and which will be, as shall become evident hereinafter, capable of operating in accordance with the invention. For example, in U.S. Pat. No. 4,247,210, issued on Jan. 27, 1981 to the assignee of the present invention, is disclosed a ribbon feed and lift mechanism for a typewriter which includes dependent ribbon feed and ribbon lift. In a like manner, in U.S. Pat. No. 4,329,072, issued on May 11, 1982, again to the assignee of the present invention, is disclosed a second dependent ribbon feed and lift mechanism for a typewriter particularly adapted, upon overlift of the cartridge, to position the correction ribbon for print correction. Once again the feed is dependent upon the lift. In U.S. Pat. No. 4,347,007, issued on Aug. 31, 1982, however, dual cartridges (print and correction) are illustrated having more than one ribbon lift and ribbon feed which are dependent upon cam position, the ribbon lift and ribbon feed being truly incremental (but not proportional) and based upon the cam position. Another mechanism disclosed in U.S. Pat. No. 4,397,575, issued on Aug. 9, 1983, discloses a ribbon lift and feed mechanism for a typewriter which is truly capable of proportional ribbon lift as well as proportional ribbon feed. This mechanism, built by one of the inventors of the present application, is found to be excellent for permitting both incremental feed and incremental lift independent of one another as by a single drive mechanism.

In accordance with the invention, when a character is to be printed, as inputted to the microprocessor 13 by the input means 11, a table in ROM 15 is accessed for the character to be printed and returns to the microprocessor 13 a predetermined plurality of characteristics of the character to be printed. The RAM 14 in conjunction with a program in the microprocessor 13, keeps track of the position on the ribbon 23 where one the prior characters has been printed and adds to that track position a particular characteristic of the character to determine a new track print position. That new position is outputted from the microprocessor 13 to the ribbon lift (and/or feed) electronics 17 (18) to effect elevation (and, if appropriate, feed) of the ribbon 23 to one of a multiple of predetermined positions so that an increased number of characters may be printed thereon.

To this end, and referring first to FIGS. 3A, 3B and 4, the characteristics of the indicia (characters) carried by the table in the ROM 15 classifies the petals of portion 24A carrying the character thereon into five discrete zones numbered 1–5 and labeled in FIG. 4 as overscore (1), ascenders (2), main (3), descenders (4), and underscore (5). A second characteristic that is necessary for proportional ribbon lift is the height of a character and their zone. For example, the letters and characters illustrated in FIG. 4, that is the graphics "a, b, g, _, Ö, _, b" each have a lower base line in the lowest zone in which they appear, and each have a height. For example, the letter "a" has a base line in the center or main zone (3). It also has a character height of "1" and a character width of "5". (Width is placed as arbitrary units, in the present instance 1/60 inches (0.423 mm) per unit of width. For example a "W" is the widest character and has a width of 7 (0.1167 inches, 2.96 mm), while an "i" has a width of 3.) Alternatively, the character "b" has a base line still in the main zone (zone 3) but has an extension upwardly which passes into the ascender zone (zone 2) and thus has a height of two zones. The character "g", while having a height of only two zones starts in the descender zone (zone 4). The remainder of the characters, with regard to height, width and baseline (zone #) may be read across the table.

Depending upon the height of the ribbon 23 (its width) the ribbon 23 may be thought of as being divided into a plurality of tracks. In the present instance, the ribbon 23 is divided into 10 such tracks each having a height equal to the height of a single zone. Clearly, and as will become evident hereinafter, zones could be further divided and the number of tracks on a print ribbon could also be further increased. However, 10 such tracks have been found to be convenient and the division of the characters into 5 zones has also been found to be convenient.

Where the ribbon 23 is so divided into 10 tracks and the number of character zones into 5, it is necessary that, in order to permit printing over the full height of the ribbon 23, (width) that the ribbon 23 be capable of being lifted through a minimum of 15 possible positions plus one extra position where the ribbon 23 is below all of the character zones. In this manner printing can occur on the lowest track, track 1 by the lowest zone, zone 5 (character zone 5 on track 1 of the ribbon 23) and on track 10, the highest track, by the highest character zone, zone 1, when the ribbon 23 is at lift position 15 which, as may be seen in FIG. 3A, aligns track 10 with character zone 1. As an example (and assuming that visibility position is where the ribbon 23 is positioned below any of the character zones, referred to as position zero), at lift position 7, a character in zone 3 may be printed on track 5 of the ribbon 23. Once again, it should be recognized that the ribbon 23 may be lifted to any number of different heights depending upon the fineness of the gearing (gear mesh 40 with pinion 45, FIG. 2B), and of the stepping motor 47 steps.

Referring now to FIG. 5, shown therein is a flow chart of a program which may be utilized by the control portion 10 of the printer 20 to effect proportional lift, and in the preferred embodiment also proportional feed of the print ribbon 23. To this end, upon initialization or POR (turning the power on to the printer 20 commonly called "Power-on-Reset" or POR) a ribbon feed occurs to present a fresh "column" of ribbon 23 opposite the printwheel 25. Simultaneously therewith, certain variables employed in the program are initialized. Set forth below is a table of the variables, their meaning, and their initialized condition:

Variables-Initial Conditions

| Mnemonic | Explanation | Initial Condition |
|---|---|---|
| LA | Ribbon lift address | 1 |
| COL | Cumulative feed distance | 0 |
| MAXW | Maximum width character in active column | 0 |
| W | Character width | 5 |
| H | Character height | 1 |
| B | Character base line or zone | 3 |
| CC | Character count | 0 |
| NXTTRK | Next unused ribbon track | 1 |

Figures 6, 7:
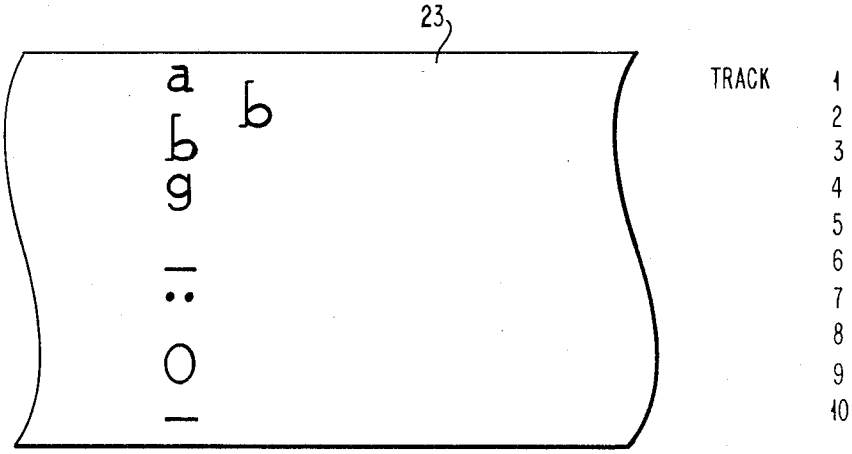
FIG. 6 is a table illustrating the program variables including ribbon lift, the character to be printed, and its height and base position as well as the next ribbon track for printing.
FIG. 7 is an enlarged fragmentary view of a portion of a ribbon (similar to FIG. 3B) illustrating the placement of the characters set forth in the tables in FIGS. 4 and 6 on the ribbon.

The base line (character zone), height, and width of several characters (by way of example only) are set forth in FIG. 4. The initial conditions are also exemplified in the table of FIG. 6. In FIG. 6, the characters are treated as being printed in the order shown. One extra condition for the readers benefit, that is a column indicating relative lift is included. This column would indicate, with respect to FIG. 3A, the lift necessary to arrive from the previous lift position to the lift position marked in the column marked lift, and will indicate relative to FIG. 3A whether the ribbon 23 must be lifted or depressed to reach a new lift position.

After initialization, the initial conditions of the program discussed hereinafter is as illustrated in the first row labeled "Initial Conditions" of FIG. 6.

When the input means receives its first character to be printed, and in this example that is the character "a", the characteristics of that character are fetched from the ROM 15 and provided as an input as at 60 to the program (FIG. 5). As illustrated in FIG. 3, the initial input conditions for the character "a" are a base line or character zone of 3, a height H of 1 and, in the present instance, a width W of 5.

Turning now to the sequence of steps or program illustrated in FIG. 5, at the outset the character count CC is incremented by 1 (as shown in block 60*a*) to keep a running count of the characters. The characters input are assumed to be those of FIG. 4, in the order that the first character is a lower case "a". The new value of H for "a" is 1. This is added to the initialized value (1) of NXTTRK in block 61 so that the new value NXTTRK is 2. The value of NXTTRK is then tested as in decision 62 to determine whether the value of NXTTRK is less than or equal the number of tracks plus 1 (that is 11). In the present instance since the value is 2, which is less than 11, the program is branched through node 63 into an algorithm in block 64 which determines the ribbon lift address, LA. As illustrated, the lift address LA is equal to 4 minus the base line (character zone) plus the value of NXTTRK. By substituting in the equation the value of 3 for B, and 2 for NXTTRK, the lift address LA will be equal to 3. When this occurs, the command LIFT RIBBON TO LA occurs as depicted in block 64*a*. By referring to FIG. 3A, opposite the legend "Lift Positions", and following up lift position 3, shows that the first character "a" which resides in character zone (3) will print at the uppermost track or track (1) of the ribbon 23. (See FIG. 7). It follows then that the relative lift is plus 3 from the initialized zero or visibility position of the ribbon 23. Thus the microprocessor 13 places an output on line 16 which causes the electronics 17 to effect a ribbon lift to the position illustrated in FIG. 3A wherein track 1 of the ribbon 23 is opposite zone (3) of the printwheel petal 24. Thereafter, in decision 65, the maximum width (which was set initially to zero) is tested against the width of the character, and in the illustrated instance since the maximum width was zero, which is less than W, the output through the yes branch and sets the maximum width (MAXW) equal to the width W or 5. The output of this logic block 66 is then provided through junction node 67 and the microprocessor 13 may output an order or PRINT COMMAND (as depicted in block 67*a*) the printer 20 to effect printing.

Assuming that the next character to be printed is the lower case "b", the table of FIG. 4 indicates that the letter "b" has a base line B of 3, a height H of 2 and a width W of 5. Once again, at input 60 these parameters (fetched from the ROM 15), will be presented to the program or sequence of steps illustrated in FIG. 5. The character count CC is incremented, (now equal to 2) and a new value of NXTTRK is calculated. As is evident from logic block 61, NXTTRK is initially 2 (the old value is carried) and adding to it the new height of 2 will give a new value to NXTTRK of 4. This is shown in the table of FIG. 6 opposite the character "b". The decision logic 62 is again tested with the equation "is NXTTRK less than or equal to 11". Since the value of NXTTRK is now 4, and less than 11, the program branches through the 'yes' branch through node 63 where a new lift address LA is calculated in the decision algorithm 64. Since the value of NXTTRK is now 4, and B is still 3, the new lift address LA is 5 and accordingly a ribbon command is given the microprocessor 13 through output 16 to lift electronics 17 to lift the ribbon 23 to the position shown in FIG. 3A opposite lift position 5. Once again the width is tested versus the new maximum width and since maximum width is not less than W, (actually, it is equal to W), the stored MAXW is not changed. A PRINT COMMAND is issued (depicted by block 67*a* in FIG. 5) by the microprocessor 13 to effect printing of the character "b".

It is noted, and as is evident from the table of FIG. 6, that while the lift address LA given in the column labeled "lift" is the absolute lift address, the relative lift to go from printing the first "a" to the printing of the second character or letter "b" requires only a plus 2. This means that the relative movement of the ribbon 23 is dependent upon the height of the character being printed and in which zone on the print petal 24 that the character resides. This will become more evident hereinafter.

The character "g" is the next one to be printed, and it has a base line or B of 4, a height H of 2 and once again a width W of 5. Following the logic through the remainder of FIG. 5, the NXTTRK value becomes 6, and the new lift address is also determined to be 6. This is evident in logic block 64 of the flow chart of FIG. 5. The base line in the equation cancels out the constant 4 (4 minus B equals 4 minus 4 equals 0) and thus the lift address LA equals the value of NXTTRK. As is illustrated, in the table of FIG. 6, this requires a relative lift of only plus one.

In the subsequent entry, where an underline is to be printed, the NXTTRK calculates to be 7, the lift address LA nevertheless remains exactly the same because it will print the underline on a lower portion of the ribbon 23. The same lift address LA is used as was used when the "g" was printed, and the underline print on the next lower track from where the "g" was printed.

The subsequent character "O" is a capital "O" with umlauts. From the ROM 15, character characteristics having a base line 3 with a height of 3 and this time a width of 6 is provided as an input as at 60. The old NXTTRK number held was 7, so the new value of NXTTRK will be 7 plus the height or 3 as calculated in decision block 61. It is noted that the NXTTRK value is still less than 11, and solving the equation in logic block 64 using a B of 3 and a NXTTRK of 10 allows printing on tracks 9, 8 and 7. Because the maximum width MAXW of the character is less than the new width W, the yes decision is taken, and MAXW will now be set equal to W or 6, and a PRINT COMMAND (block 67*a*) will be given by the microprocessor 13 to effect printing.

Assuming that the next character input by the input means 11 and supplied by the buffer 12 to the microprocessor 13 is an underline, the underline has a base line B of 5, a height H of 1 and a width W of 5. The NXTTRK figure that is fed into decision block 62 is NXTTRK equals 11 (NXTTRK equals NXTTRK plus H). A point of interest is that the result of block 64 changes the lift address from 11 (where the "O" was printed) to 10 so that track 10 aligns with character zone 5 on the print petal 24. Thus the relative lift in order to print the underline is actually a negative or minus 1. Once again since the MAXW is greater than W, the decision block answers no and as shown in block 66a, MAXW is left unchanged.

In the ensuing character printing of the letter "b", since NXTTRK had been set at 11 from the previous printing of the underline, NXTTRK=NXTTRK+H with the input of a letter "b" having characteristics of a base line B of 3 and height H of 2 would have the value of 13. In decision 62, however, NXTTRK is not less than or equal to 11 but is instead equal to 13. Therefore the decision in decision block 62 would output "no" path and the microprocessor 13 would then feed or issue a command on output 16 (FIG. 1) to the feed electronics 18 to cause the ribbon to feed the maximum character with (MAXW) encountered in the previous previous printed column. This occurs in decision block 68. Thereafter, in block 68a NXTTRK is reset equal to the new character height H plus 1, in the present instance 2 plus 1 or NXTTRK equals 3. That results in the lift address LA from block 64 for printing the "b" in the new column being equal to 4 minus B (3) plus NXYYRK (3) i.e. LA therefore equals 4.

Thus the scheme disclosed permits of proportional ribbong lift to fit an increased number of characters in a vertical column on the print ribbon 23 so as to minimize ribbon waste while maximizing ribbon usage.

Set forth below is a short basis program written for the IBM Personal Computer which emulates the characteristics of printing and ribbon lift with any characters placed thereon and which have known characteristics.

```
10   REM   This program simulates the operation of the
15   REM   ribbon control system of a wheel type printer.
20   REM   This ribbon control system is novel in that
25   REM   fresh ribbon is lifted into position, between
30   REM   the print wheel and the paper, and fed from
35   REM   the supply to the take up reel, based upon
40   REM   the characteristics of the characters to be
45   REM   printed. The characteristics of the characters
50   REM   are: 1) The characters baseline (the lowest
55   REM   printing portion of the character's shape)
60   REM   2) The character's height (the difference
65   REM   between its baseline and the highest
70   REM   printing portion of the character's shape)
80   REM   3) The character's width (its PSM escapement)
85   REM
90   REM   In this simulation, the printwheel petal is
95   REM   divided horizontally into 5 print wheel
100  REM   'zones', numbered 1 to 5 from top to
105  REM   bottom. A character's baseline is
110  REM   the highest numbered zone covered by
115  REM   its active area (for example, a lower
120  REM   case "a" baseline may be zone 3 while a
125  REM   lower case "g", because of its decender,
130  REM   may have a baseline in zone 4). A
135  REM   character's height is equal to the number
140  REM   of zones covered by its printing area
145  REM   (for example, a lower case "a" may
150  REM   be one zone tall while an upper
155  REM   case "A" may cover 2 zones with its
160  REM   greater height). A character's
165  REM   width is equal to its PSM escapement,
170  REM   which is normally measured in 1/60
175  REM   inch (.423mm) units. In this simulation,
180  REM   the ribbon is divided vertically into
185  REM   horizontally extending 'tracks'
190  REM   numbered 1 to 10 from top to bottom. The
195  REM   ribbon tracks are as tall as a print
200  REM   wheel zone. The ribbon can be lifted,
205  REM   by the ribbon lift mechanism, to any
210  REM   of 16 positions, numbered 0 to 15 from
215  REM   lowest to highest. These ribbon lift
220  REM   positions allow any ribbon track to be
```

-continued

```
225  REM   placed in front of any print wheel zone,
230  REM   including the zero position where the
235  REM   ribbon is completely below the print wheel
240  REM   (visability). A fresh column of ribbon
245  REM   is fed from the supply reel, into position
250  REM   between the print wheel and the paper, and
255  REM   onward to the take-up spool by the ribbon
260  REM   feed mechanism. The ribbon feed mechanism can
265  REM   feed ribbon in 1/60 inch (.423mm) increments,
270  REM   and its operation is independent of ribbon
275  REM   lift. NOTE that at Power On Reset of
280  REM   the ribbon lift and feed system,
285  REM   a ribbon feed for the maximum width
290  REM   character (MAXW) must be performed
300  REMM  so that a fresh column of ribbon is
305  REM   available.
310  REM   (Variables)
430  REM   LA -        Lift Address
440  REM   COL -       Cumulative feed distance
450  REM   MAXW -      Maximum width character in
                       the active column
460  REM   W           - Character width
470  REM   H           - Character height
480  REM   B           - Character baseline
490  REM   NXTTRK      - Next unused ribbon track
500  REM   R(10)       - Array used to mark unused
                       ribbon tracks of a column
510  REM   CC          - Character count
520  REM
530  REM   Initialize variables
540  LA=1:COL=0:MAXW=0:W=5:H=1:B=3:CC=
     0:NXTTRK=1
550  DIM R(10)
551  CLS
552  COLOR 2,0
553  KEY OFF
560  FOR I=1 TO 10:R(I)=0:NEXT I:REM ZERO'S
     ARRAY R(I)
570  REM Ask the user to input the character
     characteristics
580  REM In a real system this data would be obtained
     from a lookup table
590  LOCATE 24,1 :INPUT "Enter Base, Height & Width
     ";B,H,W
600  REM Increment the running character count
610  CC=CC+1
620  REM Call the subroutine to calculate the new lift
     position, determine if ribbon feed is required
630  REM and adjust the cumulative feed distance
640  GOSUB 2000
650  REM Display the new system state on the screen
660  REM In a real system, the subroutine would command
     the a set of electronics to manipulate the ribbon
670  REM lift and feed mechanism in a manner similar
680  REM to that simulated on the screen
690  CLS
700  REM Print Headings
710  LOCATE 10,1 : PRINT "Petal":PRINT "Zone"
720  LOCATE 10,25: PRINT "Ribbon": LOCATE 11,25:
     PRINT "Track"
730  REM Petal zones covered by the character's active
     area are shown flashing
750  FOR I=1 TO 5
760  LOCATE 10+I,8
770  IF I = > B - H + 1 AND I < =B THEN COLOR 18,0
780  PRINT CHR$(4B+I)
790  COLOR 2,0
800  NEXT I
810  REM Display the character's width
820  PRINT:PRINT "Width";W
830  REM The ribbon is shown in its correct position
     with used tracks in reverse
840  REM video
850  FOR I=1 TO 9
860  LOCATE 15-LA+I,20
870  IF R(I)= 1 THEN COLOR 0,7
880  PRINT CHR$(48+I)
890  COLOR 2,0
900  NEXT I
901  LOCATE 15-LA+10,20
910  IF R(10)=1 THEN COLOR 0,7
930  PRINT "10"
```

-continued

```
940   COLOR 2,0
950   REM Display Variables
960   LOCATE 1,25: PRINT "column = ";COL
970   LOCATE 2,25: PRINT "lift = ";LA
980   LOCATE 3,25: PRINT "NXTTRK = ";NXTTRK
990   LOCATE 4,25: PRINT "Count = ";CC
1000  REM Repeat process for next character
1010  GOTO 590
2000  REM Subroutine to compute the next ribbon lift
      position, the widest character in the present
2010  REM column and determine if ribbon feed is
2020  REM required
2030  REM Inputs are: NXTTRK, H,LA,MAXW,W
2040  REM Outputs are: NXTTRK, LA, R(1-10), MAXW
2050  REM Add the character's height to the next
      available track number
2060  NXTTRK= NXTTRK+H
2070  REM Check to see if the character will fit on the
      present ribbon column
2080  IF NXTTRK < = 11 THEN GOTO 2200
2090  REM Character will not fit on the present column,
      feed ribbon
2100  REM In a real system, the ribbon feed electronics
      would be instructed to feed ribbon at this
2110  REM point
2120  COL=COL+MAXW:MAXW=0:FOR I=1 TO 10:
      R(I)=0:NEXT I
2130  REM Set NXTTRK to show used tracks of the new
      ribbon column
2140  NXTTRK=H+1
2200  REM Compute new lift address
2210  LA=4-B+NXTTRK
2220  REM In a real system, the ribbon lift electronics
      would be instructed to
2230  REM lift the ribbon to the position LA
2240  REM condition array R(1-10) to show used ribbon
      tracks
2250  FOR I=1 TO NXTTRK-1: R(I)=1: NEXT I
2260  REM Capture maximum width character in MAXW
2270  IF MAXW < = W THEN MAXW = W
2280  RETURN
```

Many of the equations set forth in the basic program may be found in the flow chart of FIG. 5. The only operator input required, to make the program more flexible from an emulation standpoint, was the inputting by the operator of the base, height and width of the character to be printed. The heart of the program, after initialization, starts at line 570 through 640 and lines 2000–2280 respectively. The remaining intermediate lines are all situated in the basic program to permit an on-screen emulation of the printing of characters on the ribbon 23 and as a practical means for demonstrating maximum utilization of the ribbon 23 as it is lifted the proper amount to provide fresh ribbon 23 to a particular zone.

Thus the aforementioned lines, absent the REM statement comments, could very well be compiled and used as the program, in conjunction with the character characteristics in the ROM 15. Moreover, because of the difference in character heights, widths, etc. depending upon the character pitch, multiple lookup tables may be utilized in the ROM 15 which are addressable only by the setting of different pitch, as desired by the operator.

Thus the present invention applies proportional ribbon lift for maximizing ribbon usage while minimizing ribbon waste.

Although the invention has been described with a certain degree of particularity, it is understood that the present disclosure has been made only by way of example and that numerous changes in the details of construction, the method of operation, and the combination and arrangement of parts may be made without departing from the spirit and scope of the invention as hereinafter claimed.

What is claimed is:

1. A method for proportional ribbon tracking on a printer, said printer including first means for effecting elevation of a ribbon to multiple predetermined positions aligned with a printhead and a print-receiving medium so that indicia may be printed on said print-receiving medium, said method comprising:

receiving a character to be printed;

characterizing said character in accordance with a predetermined plurality of characteristics;

said characterizing step including the step of assigning arbitrary zones to the characters to be printed and designating on which zones the characters are positioned on the printhead; and assigning a height to the characters based upon the number of zones encompassed by said characters; and, adding with respect to a position on the ribbon upon which at least one prior character has been printed, the height of the character to be printed to determine a new print position, and outputting said new print position to said first means for effecting elevation of said ribbon to one of a multiple of said predetermined positions to approximately maximize the number of predetermined positions of said ribbon with characters printed therefrom without character overlap.

2. A method in accordance with claim 1 wherein one of said characteristics of said plurality of characteristics is the width of said character to be printed; and comparing all of the widths of characters previously printed in a column on said ribbon and comparing said widths against the width of the character to be printed, and feeding ribbon upon the occurrence of a predetermined event, an amount equal to the width of the widest character in said column of characters.

3. A method in accordance with claim 1, including the step of comparing the new track position with a predetermined number indicative of the maximum number of permissible tracks of characters in a column on said ribbon and if said new track position exceeds said maximum number, then feeding ribbon an amount equal to some predetermined amount.

4. A method in accordance with claim 3 wherein said predetermined amount of ribbon feed is determined as follows: comparing all of the widths of characters previously printed in a column on said ribbon, and feeding said ribbon an amount corresponding to the width of the widest of said characters.

5. Apparatus for providing proportional ribbon tracking on a printer, said printer including a carrier, a printhead including implements of printing mounted on said carrier, first means for effecting elevation of a ribbon to multiple predetermined track print positions aligned with said implements of printing so that indica may be printed on the print receiving medium held thereby, said apparatus comprising:

input means for receiving indicia corresponding to a character to be printed;

means for characterizing said character in accordance with a predetermined plurality of characteristics, one of said characteristics comprising the height of said character, and another characteristic of said character to be printed is its position on the implement of printing, said implement of printing having assigned thereto a plurality of arbitrary zones, each character having a lowermost portion which corresponds to a baseline zone of the position of characters on said implement, the height of the characters determining the number of zones assigned to each of said characters;

means for adding with respect to a position on the ribbon upon which at least one prior character has been printed, the height of the character to be printed to determine a new track print position; and means for outputting said new track print position to said first means for effecting elevation of said ribbon to one of a multiple of said predetermined positions to thereby approximately maximize the number of predetermined positions of said ribbon with characters thereon which may be printed without character overlap.

6. Apparatus for providing proportional ribbon tracking on a printer in accordance with claim 5 wherein one of said characteristics of said plurality of characteristics is the width of said character to be printed; means for storing the largest width of characters previously printed in a column on said ribbon and means for comparing said largest width against the width of the character to be printed, and means for feeding said ribbon upon the occurrence of a predetermined event, an amoutn equal to the width of the widest character in said column of characters.

7. Apparatus for providing proportional ribbon tracking on a printer in accordance with claim 5, including means for comparing the new track position with a predetermined number indicative of the maximum number of permissible tracks of characters in a column on said ribbon, and means responsive, if said new track position exceeds said maximum number, for feeding ribbon an amount equal to some predetermined amount.

8. Apparatus for providing proportional ribbon tracking on a printer in accordance with claim 7 including means for comparing the width of each of said characters in a column on said ribbon to determine said widest character and means responsive to said comparison for feeding said ribbon an amount corresponding to the width of the widest of said characters.

9. Apparatus for providing proportional ribbon tracking on a printer in accordance with claim 8 wherein arbitrary zones are assigned to characters to be printed as to where the characters are positioned on the implements of printing; and also including memory means for storing said zones as associated with each character; means for assigning a height to the characters based upon the number of zones encompassed by each of said characters, and means for storing said height and zones information in said memory means associated with each of said characters.

10. Apparatus for providing proportional ribbon tracking on a printer in accordance with claim 9 including means for utilizing both said character height and zone to determine the elevation of the ribbon to expose a new portion thereof in the column opposite the character to be printed by said implement of printing.

11. A ribbon feed for a text printer comprising:

means for assigning a first value to a character to be printed, said first value defining the height of said character;

means for assigning a second value to said character, said second value defining the verticle location of said character;

means for storing the combined length of a column of ribbon previously used for printing, means for combining said first value, said second value and said combined length for computing an unused location in said column in which said character can be printed, and means to position said ribbon for printing said character in said unused location.

12. A ribbon feed in accordance with claim 11, including means for comparing the width of said character being printed to the widest previous character printed in said column, and means dependent upon said comparison for feeding said ribbon laterally an amount equal to the widest character in said column upon said combining means being unable to compute an unused location in said column in which said character can be printed.

* * * * *